US009466405B2

(12) United States Patent
Lund et al.

(10) Patent No.: US 9,466,405 B2
(45) Date of Patent: Oct. 11, 2016

(54) HIGH VOLTAGE POWER CABLE FOR ULTRA DEEP WATERS APPLICATIONS

(75) Inventors: Sjur Kristian Lund, Halden (NO); Bjorn Roger Slora, Halden (NO)

(73) Assignee: NEXANS, Paris (FR)

( * ) Notice: Subject to any disclaimer, the term of this patent is extended or adjusted under 35 U.S.C. 154(b) by 333 days.

(21) Appl. No.: 13/442,110

(22) Filed: Apr. 9, 2012

(65) Prior Publication Data

US 2012/0279750 A1 Nov. 8, 2012

(30) Foreign Application Priority Data

May 2, 2011 (EP) ..... 11305517

(51) Int. Cl.
*H01B 11/04* (2006.01)
*H01B 7/04* (2006.01)
*H01B 7/18* (2006.01)

(52) U.S. Cl.
CPC ..... *H01B 7/045* (2013.01); *H01B 7/1895* (2013.01)

(58) Field of Classification Search
CPC ..... H01B 7/226; H01B 7/1895; H01B 7/285
USPC ..... 174/116, 106 R, 113 R
See application file for complete search history.

(56) References Cited

U.S. PATENT DOCUMENTS

| | | | | |
|---|---|---|---|---|
| 2,604,509 | A * | 7/1952 | Blanchard | 174/108 |
| 4,654,476 | A * | 3/1987 | Barnicol-Ottler et al. | 174/116 |
| 4,696,542 | A * | 9/1987 | Thompson | 385/108 |
| 5,902,962 | A * | 5/1999 | Gazdzinski | 174/113 R |
| 7,208,682 | B2 * | 4/2007 | Kuchta | H01B 3/446 174/110 R |
| 2006/0201698 | A1 | 9/2006 | Mjelstad | |

FOREIGN PATENT DOCUMENTS

| | | |
|---|---|---|
| GB | 360996 | * 11/1931 |
| GB | 464794 | * 4/1937 |
| WO | 2008074104 | 6/2008 |
| WO | 2011033539 | 3/2011 |

OTHER PUBLICATIONS

International Search Report dated Oct. 13, 2011.

* cited by examiner

*Primary Examiner* — Chau N Nguyen
(74) *Attorney, Agent, or Firm* — Sofer & Haroun, LLP

(57) ABSTRACT

A high voltage power cable (1) includes at least two insulated conductors (2) and an armor package (6) surrounding the conductors (2). The cable (1) has a longitudinal central element (4) of an elastic material, and longitudinal elements (3) of polymer material placed between the said insulated conductors (2).

9 Claims, 1 Drawing Sheet

HIGH VOLTAGE POWER CABLE FOR ULTRA DEEP WATERS APPLICATIONS

RELATED APPLICATION

This application claims the benefit of priority from European Patent Application No. 11 305 517.2, filed on May 2, 2011, the entirety of which is incorporated by reference.

BACKGROUND

1. Field of the Invention

The invention relates to high voltage power cable for ultra deep waters applications.

2. Description of the Related Art

Ultra deep waters can be considered as being at least 3000 meters under the sea level. At such depths, deep waters applications will induce large tensile strain on the cable. The weak element in high voltage power cable application is the metallic conductors, generally consisted of copper, due to their poor mechanical properties, and especially due to their poor elongation capacity. During installation and service, the high voltage power cable will be exposed to large tensile forces and dynamic motion which will induce fatigue problems. The metallic conductors, especially when they are made of copper material, will be damaged when they are exposed to an elongation above a critical limit. Such damage phenomena can be explained by the fact that high voltage power cable comprises an armour package with an elongation capacity of 0.3% or more, and insulated metallic conductors with a poor elongation capacity of approximately 0.1%. Consequently, when the high voltage power cable is exposed to large tensile forces, only 30% of load bearing capacity of the armour package can be used without reaching an unacceptable elongation in the metallic conductors. Due to this, it is necessary to increase the elongation capacity of the insulated metallic conductors, in order to use 100% of the load bearing capacity of the armour package and to have acceptable tensile load in the insulated metallic conductors. Hence by increasing the elongation capacity of the metallic conductors we can reach significant larger water depths.

Such cables used in deep water applications and conceived to withstand tensile forces, have been already developed and patented. For instance, EP 1691378 discloses an electrical signal cable, comprising at least two insulated conductors, and of which the main technical feature is that each of the insulated conductors is arranged in a groove of a longitudinal central element consisting of an elastic material which allows the insulated conductors to move in radial direction of the said cable when the latter is exposed to longitudinal tensile stress. The cable is surrounded by a sheath of insulated material, and the elastic material fills entirely the space inside the said sheath so that it is in contact with this sheath along its circumference, except the areas corresponding to the grooves. In other words, the insulated conductors are totally embedded inside the elastic material. This invention presents two drawbacks which are, in one hand, that each insulated conductor cannot move freely inside the electrical signal cable when exposed to large tensile forces, and on the other hand, that no device is designed inside the cable to better distribute the radial forces, so that the said cable be able to better withstand the loads.

The high voltage power cables according to the invention are designed to increase the elongation capacity of the metallic insulated conductors without the two drawbacks mentioned before. This way, they are well adapted to ultra deep waters applications by improving their resistance to very high pressure without damaging the said insulated metallic conductors.

OBJECTS AND SUMMARY

The invention relates to high voltage power cable comprising at least two insulated conductors and an armour package surrounding the said conductors. The main feature of the high voltage power cable according to the invention is that it comprises a longitudinal central element consisting of an elastic material, and longitudinal elements placed between the said insulated conductors and consisting of polymer material. This way, the central elastic element will function as soft bedding for the insulated conductors and will allow the said conductors to move towards centre due to radial forces applied from the armour package and axial tensile load in the insulated conductors themselves. The polymer elements placed between the insulated conductors will transfer the radial forces from the armour package on a large area and due to this the said insulated conductors themselves will not be deformed significantly. These polymers elements constitute supplementary passageways to transfer load from the armour package towards central elastic element, and hence relieve the strain on the insulated conductors. The combination of a central elastic element and polymer elements placed between the insulated conductors allow the insulated conductors to move towards centre due to radial forces transferred by armour package and axial tensile load. This move towards centre induces the reduction of the pitch diameter of the insulated conductors, and an access length will be obtained. This will relieve the strain on the insulated conductors.

Advantageously, the said cable comprises three power phases, each being in contact with the central elastic element and with two polymer elements. Power phase comprises a copper conductor surrounded by insulation system which consists of an inner semiconductive sheath, cross linked polyethylene insulation, an outer semi conductive sheath protected by an outer polyethylene sheath. In this high voltage power cable arrangement, there are also three polymer elements placed between power phases. The copper conductors constitute the weak elements in the cable due to their poor mechanical properties. In order to avoid the damage of the copper conductors when they are exposed to elongation above a critical limit in the case of ultra deep waters applications, a device based on a central elastic element and polymer elements between power phases is well adapted to the safeguard of the cable.

Preferentially, the said cable comprises an assembly consisting of an inner polymer sheath, an outer polymer sheath, and an armour package placed between the said sheaths, the said assembly surrounding the insulated conductors, the polymer elements being in contact with the said inner sheath. This way, by keeping a contact with armour package, the polymer elements are placed in good conditions to transmit the radial forces applied from the armour package toward centre. Preferentially, the inner and the outer sheaths consist of polyethylene.

Advantageously, the central elastic element, the polymer elements and the insulated conductors are arranged together so that two consecutive insulated conductors are separated with a free space. With such an arrangement each insulated conductor is able to move easily, rapidly and independently one from the other toward centre when exposed to radial forces. Moreover, these free spaces constitute also expending spaces for the central elastic element when insulated conductors move towards centre and deform the said elastic element.

Preferentially, the transversal cross section of the longitudinal central elastic element is approximately triangular, each of the insulated conductors being in contact with one side of the said cross section.

In one preferred embodiment of a cable according to the invention, the central elastic element consists of elastomer.

In another preferred embodiment of a cable according to the invention, the central elastic element consists of Ethylene-Propylene-Diene-Monomer (EPDM) elastomer.

In another preferred embodiment of a cable according to the invention, the central elastic element consists of natural or synthetic rubber.

Advantageously, the armour package comprises steel wires, But It may also contain composite materials consisting of aramid fiber, carbon fiber or similar. More specifically, armour package contains at least two layers.

Preferentially, the armour package which is the load bearing element is applied with a lay-angle less than the lay-angel in the centre bundle of the three power phases, the lay-angle in centre bundle and armour package being controlled by one another.

One of the great advantages of a high voltage power cable according to the invention is that it comprises a simple device resulting from the combination of a central elastic element and polymer elements between insulated conductors, the said device being easy to manufacture and to implement. Moreover, this device is well adapted to high voltage power cables intended to be used in ultra deep waters, because it remains very efficient without taking too much place. Finally, since the different materials implemented in this device are polymer and elastomer, the high voltage power cables according to the invention are not expensive.

BRIEF DESCRIPTION OF THE DRAWINGS

A detailed description of one preferred embodiment of a high voltage power cable according to the invention is given referring to FIGS. 1 and 2.

DETAILED DESCRIPTION

Figure 1:
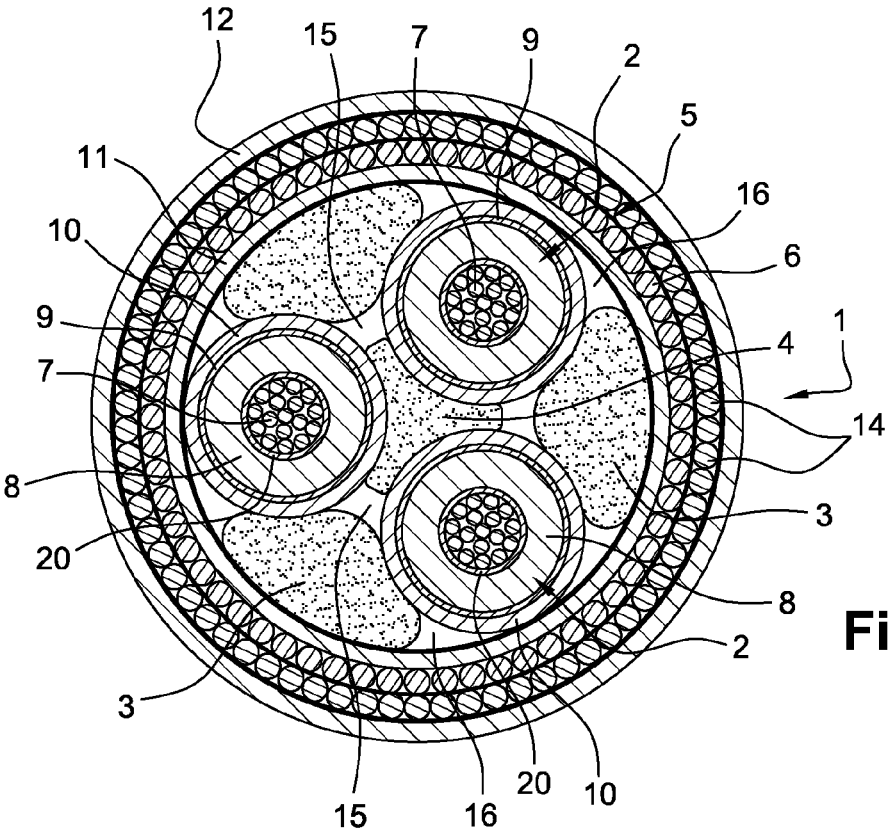
FIG. 1 is a cross section view of a high voltage power cable according to the invention.

Referring to FIG. 1, a high voltage power cable 1 according to the invention, comprises three insulated conductors 2 also called "power phases", three polymer elements 3 placed between power phases 2, a longitudinal central element 4 consisting of elastic material, all the elements 2,3,4 being surrounded by an assembly 5 including an armour package 6. The longitudinal central element 4 consists of an elastomer such as EPDM, and has a triangular cross section. A power phase 2 comprises a copper conductor 7 surrounded by an insulation system consisting of an inner semi conductive sheath 20, cross linked polyethylene insulation 8, an outer semi conductive sheath 9 protected by an outer protective polyethylene sheath 10. The assembly 5 including the armour package 6 comprises an inner sheath 11 consisting of polyethylene, an outer sheath 12 consisting of polyethylene and the armour package 6 placed between the said sheaths 11, 12, the said assembly 5 surrounding power phases 2, polymer elements 3 and the central elastic element 4. The armour package 6 consists of two superposed layers of steel wires 14. The insulated conductors 2, the polymer elements 3 and the central elastic element 4 are arranged together so that one polymer element 3 is in contact with the inner polyethylene sheath 11 and with two insulated conductors 2, and so that one insulated conductor 2 is in contact with one side of the triangular cross section of the central elastic element 4. With such an arrangement two consecutive insulated conductors 2 are separated with a free space 15. We also find free spaces 16 between an insulated conductor 2, a polymer element 3 and the inner polyethylene sheath 11. When the high voltage power cable 1 is exposed to radial load, all the free spaces 15,16 are intended to facilitate the move of the insulated conductors 2 towards the centre.

Figure 2:
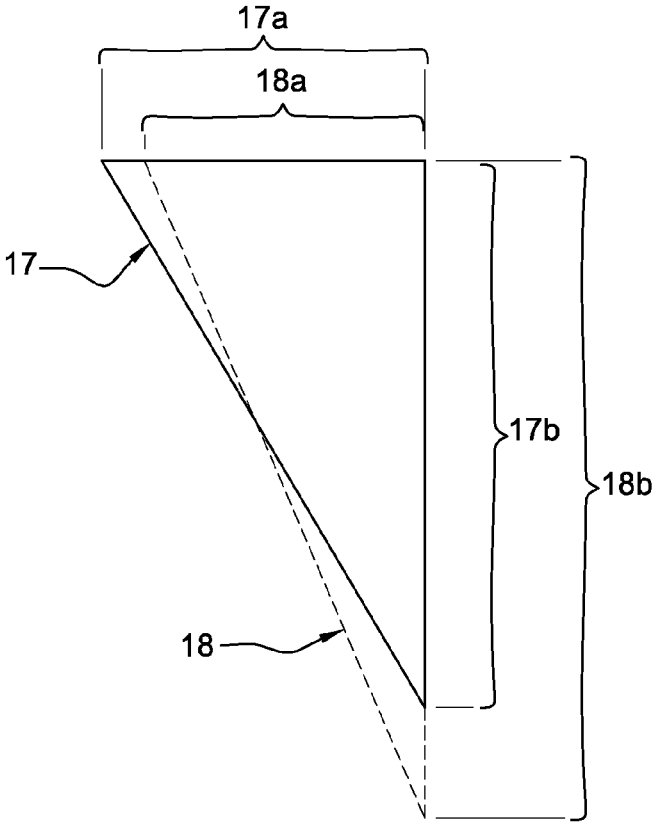
FIG. 2 is a schematic view of a power phase included in a high voltage power cable according to the invention, with an without axial tension.

Referring to FIG. 2, the presence of polymer elements 3 and central elastic element 4, makes possible that the insulated copper conductors 2 move easily towards centre of the cable 1. From the initial position 17 of the copper conductors 2 into the cable 1 without any axial tension, to their final position 18 into the said cable 1 after moving towards center when exposed to axial tension, the pitch diameter decreases from an initial value 17*a* to a final value 18*a*, whereas the length of the said copper conductors 2 increases from an initial value 17*b* to a final value 18*b*. The armour package 6 will also elongate in axial direction due to radial displacement. This armour package 6 which is the load bearing element will be applied with a lay-angle less than the lay-angel in the centre bundle of the three power phases 2. The lay-angle in centre bundle and armour package 6 is controlled by one another. In an optimized cable 1 there will be low tension in the power phases 2 due to the access length 18*b* induced by the change in pitch diameter 18*a*.

The elastomeric central element 4 and polymer elements 3 in the centre bundle and optimized lay angels between the power phases 2 and armour package 6 makes the high voltage power cable 1 fit for purpose in water depths greater than 3000 m.

The invention claimed is:

1. High voltage power cable comprising:

at least two insulated conductors with an elongation capacity of approximately 0.1%, each of said insulated conductors constructed with a central copper conductor, an inner semi conductive sheath surrounding the conductor, a cross-linked polymer sheath surrounding the inner semi conductive sheath, an outer semi conductive sheath surrounding the cross-linked polymer sheath, and an outer protective polymer sheath surrounding said outer semi conductive sheath; and an armour package surrounding said insulated conductors having an elongation capacity of 0.3% or more, said armour package has at least two layer's at least one of which is made from composite materials including either one of aramid or carbon fibers, wherein said cable has a longitudinal central element of an elastic material, and longitudinal elements of a polymer material placed between the insulated conductors, wherein the central elastic element functions as soft bedding and allows said insulated conductors to move toward center under radial forces applied from said armour packaging and, under axial tensile load in said insulated conductors from the elongation capacities difference between said insulated conductors and said armour package, wherein said polymer elements being supplementary passageways for transferring loads from said armour package towards said longitudinal central element and hence relieve the strain on said insulated conductors.

2. High voltage power cable according to claim 1, wherein said insulated conductors have three power phases, each being in contact with the central elastic element and with two of said polymer elements.

3. High voltage power cable according to claim 2, wherein the transversal cross section of the longitudinal central elastic element is approximately triangular, each of the insulated conductors being in contact with one side of the cross section.

4. High voltage power cable according to claim 2, wherein at least one of said two layers of the armour package is made from steel wires.

5. High voltage power cable according to claim 2, wherein the armour package which is the load bearing element is applied with a lay-angle less than the lay-angle in the centre bundle of the three power phases, the lay-angle in the centre bundle and armour package is controlled by one another.

6. High voltage power cable according to claim 1, wherein the central elastic element includes elastomer.

7. High voltage power cable according to claim 6, wherein the central elastic element includes EPDM elastomer.

8. High voltage power cable according to claim 1, wherein the central elastic clement includes either one of natural or synthetic rubber.

9. High voltage power cable according to claim 1, wherein said cross-linked polymer sheath and said outer protective polymer sheath are made from polyethylene.

* * * * *